US008356722B2

(12) United States Patent
Dubs et al.

(10) Patent No.: US 8,356,722 B2
(45) Date of Patent: Jan. 22, 2013

(54) CONTAINER, PARTICULARLY A BEVERAGE BOTTLE

(75) Inventors: Hans-Dieter Dubs, Worms (DE); Jurgen Soldan, Worms (DE); Karl Matheis, Alzey-Weinheim (DE)

(73) Assignee: Alcoa Deutschland GmbH, Worms (DE)

( * ) Notice: Subject to any disclaimer, the term of this patent is extended or adjusted under 35 U.S.C. 154(b) by 0 days.

(21) Appl. No.: 12/751,499

(22) Filed: Mar. 31, 2010

(65) Prior Publication Data

US 2010/0252524 A1 Oct. 7, 2010

Related U.S. Application Data

(63) Continuation of application No. 10/497,879, filed as application No. PCT/EP02/14004 on Dec. 10, 2002.

(30) Foreign Application Priority Data

| | | |
|---|---|---|
| Dec. 10, 2001 | (DE) | 201 19 969 |
| Jan. 25, 2002 | (DE) | 102 02 902 |
| Mar. 22, 2002 | (DE) | 102 12 877 |
| May 28, 2002 | (DE) | 102 24 369 |
| Jul. 29, 2002 | (DE) | 102 35 515 |

(51) Int. Cl.
*B65D 41/62* (2006.01)

(52) U.S. Cl. ..... 215/277; 215/354; 215/355; 215/363; 215/298

(58) Field of Classification Search ..... 215/274, 215/387, 329, 354, 345, 355, 363, 328, 225, 215/277; 220/255
See application file for complete search history.

(56) References Cited

U.S. PATENT DOCUMENTS

| | | | | | |
|---|---|---|---|---|---|
| 701,101 | A | * | 5/1902 | Stutz | 215/355 |
| 746,332 | A | * | 12/1903 | Hicks | 215/274 |
| 824,210 | A | * | 6/1906 | Sauer | 215/321 |
| 1,025,942 | A | | 5/1912 | Bellamy | |
| 1,124,173 | A | | 1/1915 | Rollins | |
| 1,240,072 | A | * | 9/1917 | Maiden | 215/6 |
| 1,603,116 | A | * | 10/1926 | Kaye | 215/274 |
| 1,645,720 | A | | 1/1928 | Clark | |
| 1,654,720 | A | * | 1/1928 | Clark | 215/251 |
| 1,803,225 | A | | 4/1931 | Wiener | |
| 2,010,257 | A | | 8/1935 | Fehse | |

(Continued)

FOREIGN PATENT DOCUMENTS

| | | |
|---|---|---|
| DE | 67786 | 4/1907 |

(Continued)

OTHER PUBLICATIONS

International Search Report for PCT/EP02/14004, dated May 21, 2003, ISA/EPO.

(Continued)

*Primary Examiner* — Anthony Stashick
*Assistant Examiner* — Christopher McKinley
(74) *Attorney, Agent, or Firm* — Harness, Dickey & Pierce, P.L.C.

(57) ABSTRACT

A container, particularly a beverage bottle, can be closed in a bottle opening of a bottle body with a closure made of a plastic material or glass. A fixing element is detachable fastened to the bottle body and holds the closure in the bottle opening. Such a bottle closure solves the problems involving, in particular, wine bottles and which arise when otherwise common bottle cork stoppers are used.

27 Claims, 14 Drawing Sheets

U.S. PATENT DOCUMENTS

| | | | | | |
|---|---|---|---|---|---|
| 2,116,421 | A | | 5/1938 | Williams | |
| 2,149,378 | A | * | 3/1939 | Winslow | 53/423 |
| 2,536,426 | A | * | 1/1951 | De Oliverira | 215/277 |
| 2,666,542 | A | * | 1/1954 | Price | 215/232 |
| 2,734,649 | A | * | 2/1956 | Callahan et al. | 215/233 |
| 3,109,549 | A | * | 11/1963 | Conklin | 215/270 |
| 3,245,569 | A | * | 4/1966 | Essich | 215/329 |
| 3,392,859 | A | * | 7/1968 | Fischer | 215/247 |
| 3,559,834 | A | * | 2/1971 | Taylor | 215/261 |
| 3,603,469 | A | | 9/1971 | Magni | |
| 3,760,969 | A | * | 9/1973 | Shimamoto et al. | 215/247 |
| 3,937,350 | A | * | 2/1976 | Volker | 215/361 |
| 4,231,486 | A | * | 11/1980 | Bock | 220/266 |
| 4,441,621 | A | * | 4/1984 | Matukura et al. | 215/247 |
| 4,506,797 | A | * | 3/1985 | Bullock, III | 215/256 |
| 4,650,083 | A | * | 3/1987 | Lembeck | 215/307 |
| 4,724,028 | A | * | 2/1988 | Zabielski et al. | 156/256 |
| 4,801,040 | A | * | 1/1989 | Kraus | 220/787 |
| 4,838,442 | A | * | 6/1989 | Merry | 215/228 |
| 5,038,952 | A | | 8/1991 | Dorfman | |
| 5,109,997 | A | * | 5/1992 | Phillips | 215/360 |
| 5,261,547 | A | * | 11/1993 | Finke | 215/233 |
| 5,288,466 | A | * | 2/1994 | Burns | 422/102 |
| 5,316,163 | A | * | 5/1994 | von Schuckmann | 215/249 |
| 5,370,252 | A | * | 12/1994 | Parsons et al. | 215/247 |
| 5,405,033 | A | * | 4/1995 | Sweed | 215/306 |
| 5,603,422 | A | * | 2/1997 | Herrmann | 215/256 |
| 5,654,022 | A | * | 8/1997 | Sayre | 426/118 |
| 5,662,233 | A | * | 9/1997 | Reid | 215/273 |
| 5,826,739 | A | * | 10/1998 | Valyi | 215/253 |
| 5,845,797 | A | * | 12/1998 | Sudo et al. | 215/247 |
| 5,868,264 | A | * | 2/1999 | Fulford et al. | 215/232 |
| 5,884,786 | A | * | 3/1999 | Valyi | 215/44 |
| 5,975,322 | A | * | 11/1999 | Reid | 215/273 |
| 6,024,235 | A | * | 2/2000 | Schwab | 215/247 |
| 6,158,604 | A | * | 12/2000 | Larguia et al. | 215/217 |
| 6,426,049 | B1 | * | 7/2002 | Rosen et al. | 422/102 |
| 6,499,618 | B1 | * | 12/2002 | Leclerc et al. | 215/364 |
| 7,121,419 | B2 | | 10/2006 | Ferry et al. | |
| 7,124,905 | B2 | * | 10/2006 | Granger et al. | 215/329 |
| 7,426,999 | B2 | * | 9/2008 | Leendersten et al. | 215/355 |
| 2002/0023893 | A1 | * | 2/2002 | Sudo et al. | 215/355 |
| 2006/0151422 | A1 | * | 7/2006 | Manley | 215/341 |

FOREIGN PATENT DOCUMENTS

| | | | |
|---|---|---|---|
| DE | 1 743 126 | | 11/1957 |
| DE | 1 786 702 | | 4/1959 |
| DE | 1 273 354 | | 7/1968 |
| DE | 1 757 413 | | 4/1971 |
| DE | 35 38 358 | | 4/1987 |
| DE | G 87 03 422.0 | | 5/1987 |
| DE | G 87 12 572.2 | | 12/1987 |
| DE | G 88716 207.9 | | 5/1989 |
| DE | 93 15 073.3 | | 4/1994 |
| DE | 295 15 494 | U1 | 1/1996 |
| DE | 196 16 616 | | 11/1997 |
| DE | 196 49 030 | A1 | 6/1998 |
| DE | 201 19 969 | U1 | 3/2002 |
| EP | 0 798 225 | A1 | 3/1997 |
| EP | 0 861 811 | B1 | 2/1998 |
| FR | 2 598 137 | | 5/1986 |
| FR | 2 705 645 | | 12/1994 |
| GB | 575393 | | 2/1946 |

OTHER PUBLICATIONS

English translation of International Search Report for PCT/EP02/14004, ISA/EPO, dated May 21, 2003.

Search Report in corresponding Chilean Patent Application No. 2819-02, dated Dec. 9, 2002.

* cited by examiner

CONTAINER, PARTICULARLY A BEVERAGE BOTTLE

CROSS-REFERENCE TO RELATED APPLICATIONS

This application is a continuation of U.S. patent application Ser. No. 10/497,879 filed on 28 Mar. 2005, which is a National Stage of International Application No. PCT/EP02/014004 filed 10 Dec. 2002, which claims benefit of German Patent Application No. 201 19 969.6 filed Dec. 10, 2001, which claims benefit of German Patent Application No. 102 02 902.4 filed Jan. 25, 2002, which claims benefit of German Patent Application No. 102 12 877.4 filed Mar. 22, 2002, which claims benefit of German Patent Application No. 102 24 369.7 filed 28 May 2002, which claims benefit of German Patent Application No. 102 35 515.0 filed Jul. 29, 2002. The entire disclosures of each of the above applications are incorporated herein by reference.

BACKGROUND

Wine bottles are usually stoppered with natural cork stoppers that can be inserted into the bottle opening. For wine producers as well as for consumers there exists a not-negligible risk that the natural cork stopper will not completely seal the bottle so that either the wine will leak out or air will penetrate in. As a result, in most cases the wine inside the bottle will deteriorate (typical cork flavor!) exposing the wine producer, in particular, to considerable financial losses.

In connection with wine consumption, glass carafes are known which after they are filled with wine from a common wine bottle can be stoppered with a glass stopper.

The object of the invention is to indicate a container, particularly a beverage bottle, wherein the beverage, particularly a sensitive beverage such as wine, can be stored over a long period of time safely and reliably and protected from harmful environmental influences.

According to the invention, this objective is reached by means of a closable container, particularly a beverage bottle. Advantageous further embodiments are covered by the dependent claims.

A fixing element ensures that the closure is kept in axial and/or radial direction. Depending on the configuration of the sealed bottle between the closure and the bottle opening, it is sufficient to fix the closure to keep it reliably in its sealing position. As a result, the beverage bottle can be transported as desired and stored for years.

The use of a closure made of plastic material with a PVC-containing or PVC-free insert can have the drawback that the plastics used may release vapors that can end up in the wine. Moreover, the alcohol contained in the wine can leach out the components from the composite or from the plastic material. A crucial drawback can also be the fact that such closures are not accepted by customers who want to enjoy a high-quality natural product.

SUMMARY

The beverage bottle has a closure that can be introduced into the bottle opening and which is made entirely of glass. Glass is also the material from which the actual bottle body is made in the known manner. This material is accepted also by sensitive consumers, whereas closures made of plastic material or the like are rejected. Furthermore, a glass closure can be fabricated so as to meet much stricter quality standards than can a natural product such as cork. Moreover, with a glass closure it is possible to achieve much more reliable sealing of the bottle opening than with natural cork which can dry out or possibly contain inclusions through which air can reach the beverage to be protected.

Advantageously, between the fixing element and the closure there exists a positive or a frictional connection which blocks the turning of the closure in the bottle opening. In this manner, besides the afore-described axial fixing, a radial movement of the closure is prevented so that the closure is firmly positioned in the bottle opening. Even when during transport the beverage bottle is exposed to vibrations and/or oscillations, a tight connection between the closure and the bottle opening is retained.

According to a preferred embodiment of the invention, the fixing element can at least in the radial direction be positively fastened to a bottle rim adjoining the bottle opening. As a result, it is possible to apply to the bottle body bearing the bottle rim the axial force needed for axial fixation of the closure and which is to be taken up by the fixing element. The same effect is achieved when the fixing element is frictionally fixed to the bottle rim in the radial direction.

It is particularly advantageous if the fixing element is provided with a safety element which can be deformed or destroyed in a manner such that the positive or frictional connection of the fixing element to the bottle rim is loosened. The safety element can be, for example, a strip of plastic material or metal, preferably of tine plate, or particularly aluminum, which the consumer can readily bend or tear off so as to detach the fixing element from the bottle rim and finally to remove the closure from the bottle opening.

In a particular embodiment of the invention, a locking element, particularly a thread, is provided, for example, on an outer surface of the closure, said locking element meshing with a holding device, for example a mating thread, provided on the bottle opening.

The arrangement consisting of a locking element and a holding device—particularly when said locking element is a thread—ensures particularly stable axial fixation of the closure in the bottle opening. The fixing element then must hold the closure only in the radial direction to prevent the closure from turning in the bottle opening.

In another embodiment of the invention, the closure is provided with a conical, preferably ground outer surface to which corresponds a conical, also ground countersurface in the bottle opening. It is known that the ground, conical glass surfaces can provide very effective sealing between themselves. In addition, the outer surfaces are readily fabricated.

Advantageously, the top side of the closure is provided with a gripping device that makes it easier for the consumer to pull the closure from the bottle opening or to turn it.

In still another embodiment of the invention, a seal is inserted between the closure and the bottle rim, said seal being pressed against the bottle rim by a flange provided on the closure. To obtain the initial stress needed for sealing, after the beverage bottle is filled, the closure is pressed with the seal against the rim of the bottle and the flange of the closure and the bottle rim are enveloped by, for example, a snap cap (supplied by Pohl GmbH).

Here, to the snap cap acting as fixing element is attached a ring serving as safety element and which can be torn off the snap cap and thus detached from the bottle.

When the snap cap is made of metal, preferably aluminum, and envelops both the flange of the closure and the bottle rim, its axial holding power is sufficient to support the sealing action.

In another, particularly advantageous embodiment of the invention, the fixing element is shaped in the form of a ring or sleeve and envelops the flange of the closure and the back taper at the bottle rim. A safety element is a component of the fixing element and can be detached therefrom by the fact that at east the part of the fixing element that envelops the flange of the closure can be removed from the closure.

According to this embodiment, it is of particular interest if the safety element forms the lower part of the fixing element and is detachably connected with the upper part of the fixing element. The region of the connection can be cut open with a tool, for example a knife, so that the lower part of the fixing element, and particularly the part engaging the back taper of the bottle rim, drops off downward while the upper part of the fixing element that envelops the flange of the closure can be lifted upward. In this manner, the bottle closure can be opened in simple fashion with a knife or some other cutting device.

Preferably, the connection region between the upper and the lower part of the fixing element is provided with a perforation, a ring-shaped notch or some other kind of material weakening to facilitate the opening of the bottle.

Advantageously, the safety element is configured as a divided ring or as a closed ring with a perforation at which the ring can be opened. In this case, the safety element that, for example, forms the lower part of the fixing element and as a ring at first remains on the neck of the bottle, can readily be removed. This improves the esthetic effect of the beverage bottle and prevents injuries that could be caused, for example, by sharp edges of the fixing element that is preferably made of aluminum or of a plastic material.

In another advantageous embodiment of the invention, a spring device is provided between the fixing element and the top side of the closure. The spring device can be made of, for example, stainless steel or a plastic material and it makes it possible to stabilize the preliminary tension acting on the seal and which is to be maintained by the fixing element. Namely, even when because of thermal fluctuations the fixing element yields somewhat, the resulting extension is partly compensated for and taken over by the spring device so that, as before, the seal is maintained with the required sealing force. Temperature-dependent or age-dependent stretching of the usually ring-shaped or sleeve-shaped fixing element as well as manufacture-related inaccuracies during the closing of the beverage bottle can be compensated for in this manner. The risk of a reduced sealing action and even the leaking of the bottle can be effectively prevented.

Suitable are different kinds of stainless steel or plastic springs as well as leaf springs or disk springs. Also suitable is, for example, an air cushion embedded in a plastic bubble.

In another embodiment of the invention, the fixing element is configured as a cap that can be pushed axially over the closure and on which are provided catches or an all-around flange that engages the back taper at the bottle rim. In this manner, it is possible to push the fixing element over the closure and the bottle rim until the catches engage the back taper at the bottle rim and lock without the need for additional tools.

The beverage bottle of the invention can be used particularly advantageously for commercial filling with wine. Because of the special combination of individual elements which in themselves are known with a wine bottle, it is possible to solve the "cork problem" which has existed from time immemorial.

A another preferred embodiment of the beverage bottle is characterized in that the closure is provided with a base essentially in the form of a circular disk from which extends a central guiding body essentially in the form of a circular cylinder which becomes narrower at tits free end. Seen in longitudinal cross-section, a right angle exists at the intersection between the base and the guiding body. Seen in longitudinal cross-section, the base and the guiding body form two arms forming a right angle between them.

Another preferred embodiment of the beverage bottle is characterized in that the base has on the side of the guiding body, viewed in longitudinal cross-section, an essentially rectangular recess intended for partial uptake of a sealing element. The sealing element can be cast onto the closure or be loose.

Another preferred embodiment of the beverage bottle is characterized in that, viewed in longitudinal cross-section, the base is provided radially outside on the side of the guiding body with a, particularly rectangular, projection which limits the recess in the base. The purpose of the projection is to fix the sealing element. It can be advantageous to provide a back taper at the projection to prevent an undesirable detachment of the sealing element from the closure.

Another preferred embodiment of the beverage bottle is characterized in that from the recess in the base extends an essentially rectangular recess in the guiding body which is disposed essentially perpendicular to the recess in the base. The two elongated recesses together form a receiving space for part of the sealing element.

Another preferred embodiment of the beverage bottle is characterized in that between the closure and the bottle opening there is disposed an essentially annular sealing element the cross-section of which has two arms disposed at a right angle to each other, of which the first arm can rest on the front side of the bottle opening and the second one on the inside of the bottle opening. The bottle opening may also be referred to as the bottleneck. In the closed condition of the bottle, the second arm thus rests at least in part inside the bottleneck. The first arm rests on the mouth of the bottle.

Another preferred embodiment of the beverage bottle is characterized in that, viewed in cross-section, the first arm of the sealing element is provided on the side facing away from the closure with one or more projections. The projections form all-around sealing lips which ensure good sealing when the base is pressed against the bottle opening.

Another preferred embodiment of the beverage bottle is characterized in that on the first arm of the sealing element, viewed in cross-section, there are two flat areas facing each other and forming, in particular, an angle of about 45° with the surface of the first arm. The two flat areas a the ends of the first arm form two phases intended for sealing when the base of the closure is pressed against the bottle opening by the fixing element.

Another preferred embodiment of the beverage bottle is characterized in that, viewed in cross-section, on the side facing away from the closure the first arm of the sealing element is concave. Viewed in cross-section, the concave configuration of the arm surface results in two sealing sites when the arm rests on an essentially rectangular bottleneck mouth. The two corners of the bottleneck mouth can bury themselves into the flat areas.

Another preferred embodiment of the beverage bottle is characterized in that, viewed in cross-section, a, particularly rounded-off, projection is provided at the free end or in the vicinity of the free end of the second arm of the sealing element. The projection ensures good sealing even when the closure, for example on reclosing the bottle, is not pressed against the bottle opening by the fixing element.

Another preferred embodiment of the beverage bottle is characterized in that, viewed in cross-section, the second arm of the sealing element becomes narrower at its free end. The narrowing of the second arm of the sealing element is preferably adapted to the narrowing of the guiding body so as to facilitate the introduction of the closure and the sealing element into the bottle opening.

Another preferred embodiment of the beverage bottle is characterized in that, viewed in longitudinal cross-section, the second arm of the sealing element widens at its free end. The essentially wedge-shaped widening ensures good sealing even when the closure, for example on reclosing of the bottle, is not pressed against the bottle opening by the fixing element.

Another preferred embodiment of the beverage bottle is characterized in that in the closure, viewed in longitudinal cross-section, is provided a convexity for receiving the said widening, particularly during the opening of the bottle. In the closure, the convexity forms a groove which can have a trapezoidal cross-section. The groove, however, can also have a semi-circular or triangular cross-section.

Another preferred embodiment of the beverage bottle is characterized in that a rounded-off thickening is provided at the free end of the second arm of the sealing element. The thickening forms a circular bulge which in the closed position of the bottle is pressed against the inside of the bottleneck. This provides good sealing even when the closure, for example during bottle reclosure, is not pressed against the bottle opening by the fixing element.

In principle, the container claimed within the scope of the present invention, particularly the claimed bottle, can be made of or consist of glass, plastic material, ceramic material or metal, preferably aluminum. The bottle opening can be conical or nonconical and ground or not ground. The closure can be made of glass, plastic material or ceramic material. Said closure can be ground or not ground and, corresponding to the bottle opening, conical or nonconical. The fixing element can be made or consists of metal, preferably aluminum, or of a plastic material. The fixing element can be made, for example, of wire mesh or as a clip.

DRAWINGS

In the following, these and other features and advantages will be explained in further detail by reference to examples and with the aid of drawings in which.

DETAILED DESCRIPTION

Figure 1:
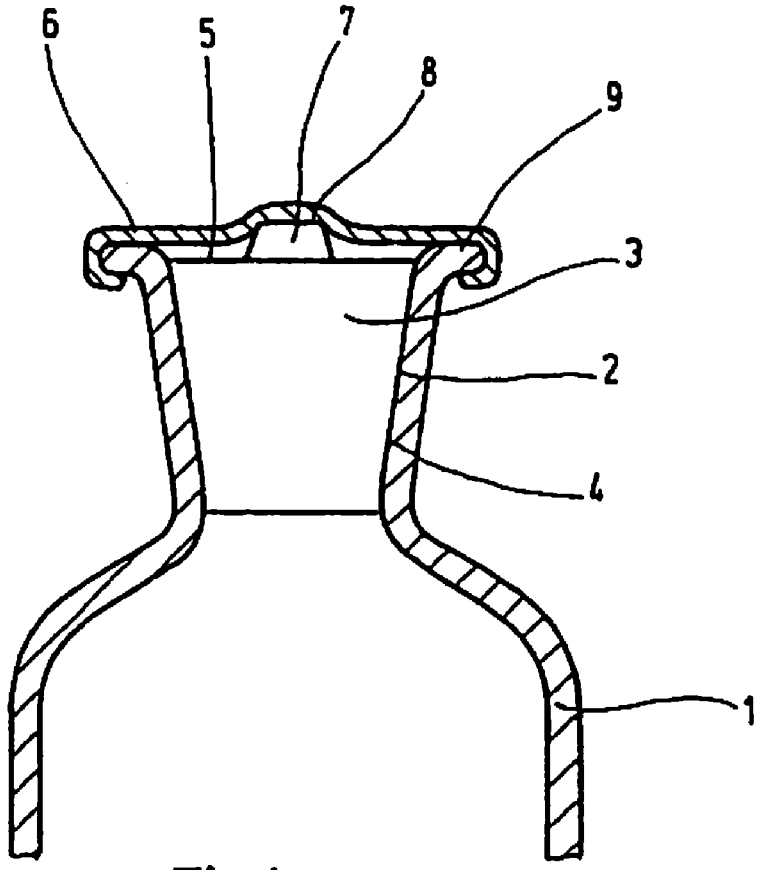
FIG. 1 shows a partial cross-section of a beverage bottle according to a first embodiment of the invention.

FIG. 1 shows a cross-section of the first embodiment of the invention with a bottle body 1 of essentially common shape and having at its upper end a bottle opening 2. Bottle body 1 is preferably made of glass. A bottle body made of a plastic material or of stoneware can conceivably also be used. In a particularly advantageous case, the bottle body is the body of a wine bottle, but it can also be a bottle for any other alcoholic beverage or for oil or vinegar.

In bottle opening 2 is inserted a closure 3 made entirely of glass. Said closure has a conical, ground outer surface that cooperates via a sealing surface 4 with a correspondingly shaped, also conical, ground inner surface of bottle opening 2. Such a sealing principle is already known from wine carafes with ground-glass stoppers. At a low cost, it is possible to configure, and particularly to grind, the conical surfaces of closure 3 and bottle opening 2 that cooperate at sealing surface 4 so accurately that complete liquid tightness and gas tightness is achieved even over a long period of time. Moreover, the flat angle of the cone defining sealing surface 4 has a certain self-retention which holds closure 3 in bottle opening 2. The self-retention is enhanced by the fact that a small amount of liquid beverage stored inside bottle body 1 can reach sealing surface 4 and hold closure 3 by an adhesive action.

To achieve complete fixation of closure 3 relative to bottle opening 2 that would impair the sealing action at sealing surface 4, fixing element 6 holds closure 3 also in the radial direction thus preventing rotation of closure 3. To this end, top side 5 of closure 3 is provided with an extension 7 which constitutes a single unit with closure 3, said extension 7 fitting in a corresponding recess 8 of fixing element 6. Extension 7 can be made of glass or of some other material.

Moreover, to prevent possible movement of closure 3 relative to bottle opening 2 that would impair the sealing action at sealing surface 4, fixing element 6 holds closure 3 also in the radial direction thus preventing rotation of closure 3. To this end, top side 5 of closure 3 is provided with an extension 7 which constitutes a single unit with closure 3, said extension 7 fitting in a corresponding recess 8 of fixing element 6. Extension 7 can be made of glass or of some other material.

Naturally, it is also possible to provide in top side 5 of closure 3 a recess that engages into the extension of fixing element 6. The only thing that matters in this respect is that a reliable positive or frictional connection exists between closure 3 and fixing element 6.

Figure 2:
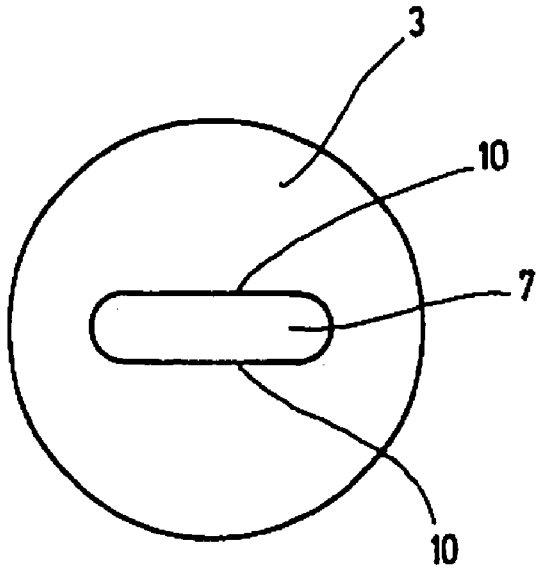
FIG. 2 shows a top view of a closure.

FIG. 2 is a top view of closure 3 with longitudinally disposed extension 7. On the lateral surfaces of extension 7, there are provided grip surfaces 10 whereby the consumer can grasp closure 3 with his/her fingers and remove it by turning or pulling.

In place of grip surfaces 10, the top of closure 3 can be provided with depressions to accommodate the consumer's fingers.

For support, fixing element 6 which by holding closure 3 absorbs the axially and radially acting forces is fastened on a bottle rim 9 provided on bottle body 1. In FIG. 1, bottle rim 9 is represented as a narrow flange. On beer bottles, however, said rim can have, for example, the usual round cross-section to hold a crown cap.

Positive and frictional connections are also possible for fastening fixing element 6 to bottle rim 9 such as, for example, those known to be used for crown caps on beer bottles. For example, fixing element 6 can consist of an elastically/plastically deformable sheet metal material which for the purpose of opening the beverage bottle can be bent in order to remove fixing element 6 and thus to obtain free access to closure 3. As an alternative, it is also possible to provide on fixing element 6 a safety element, for example a sheet metal ring or a detachable sheet metal strip, the removal of which allows fixing element 6 to be detached from bottle rim 9.

As an alternative, fixing element 6 can be made of a flexible plastic material, for example as in a so-called shrink band, which can either be extended so that to remove it from bottle body 1 it must be slipped over bottle rim 9 or which can be destroyed, preferably by tearing, so that it can be readily removed.

It is of no consequence for the quality of the beverage stored in the beverage bottle whether the fixing element is made of metal or of a plastic material, because fixing element 6 does not come in direct contact with the beverage. Rather, the beverage touches only bottle body 1 and closure 3 both of which are preferable made of glass. This leads objectively to a clearly improved storage quality and lesser quality losses than those occurring, in particular, with natural cork. At the same time, glass as material for storage containers for foodstuffs is much more trusted by consumers than are other natural materials or flavor-affecting plastic materials.

It is not necessary to provide a seal between fixing element 6 and bottle rim 9 or bottle opening 2.

Figure 3:
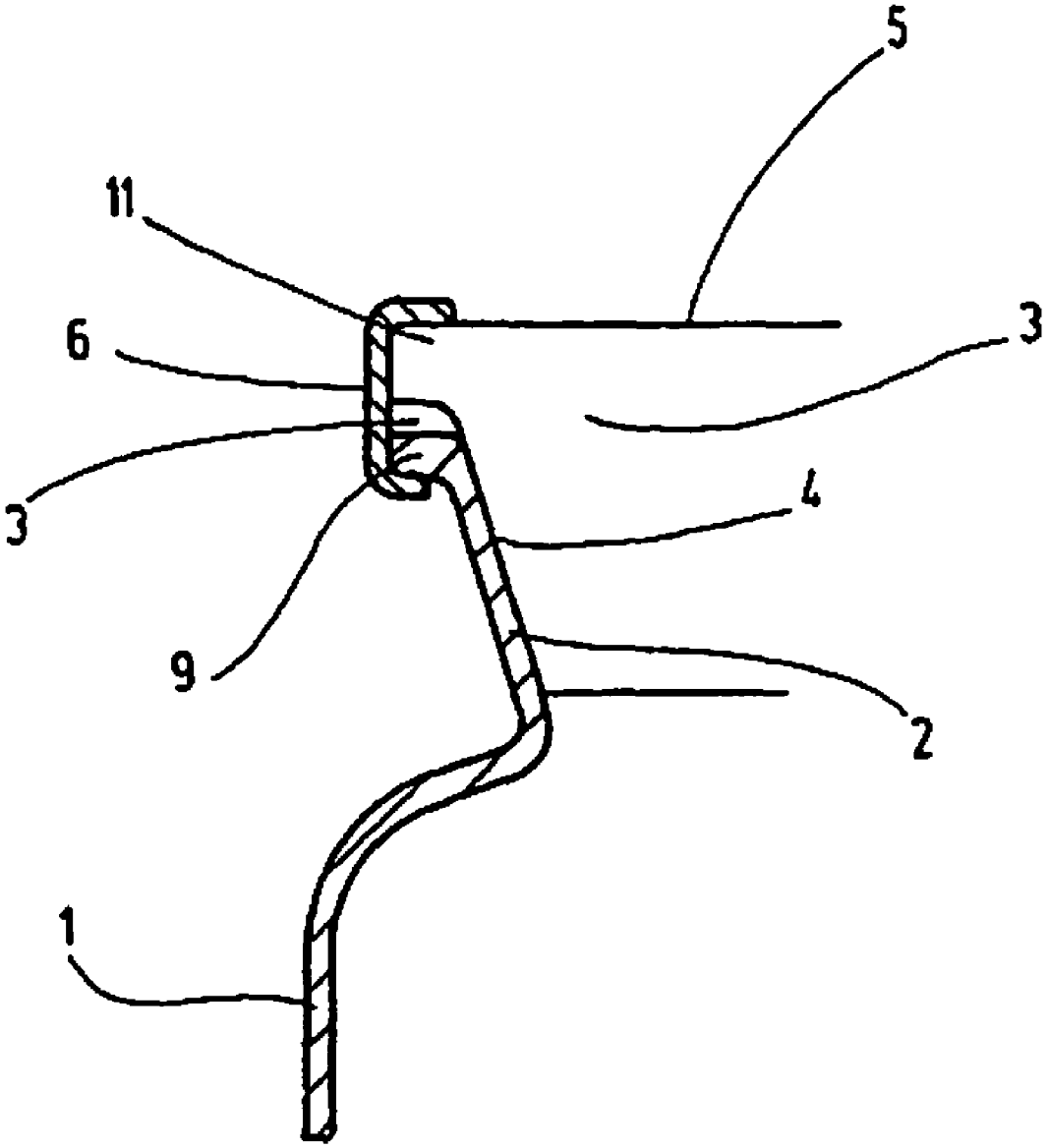
FIG. 3 shows a partial cross-section of a beverage bottle according to a second embodiment of the invention.

FIG. 3 shows a second embodiment of the invention.

Here, closure 3 is not completely inserted into bottle opening 2 but with an edge 11 overlaps bottle opening 2. Fixing element 6 is ring-shaped and embraces top side 5 of the closure and bottle rim 9 so as to positively hold closure 3 in the axial direction.

In addition, as a result of friction between top side 5, edge 11, fixing element 6 and bottle rim 9, a frictional connection is created which holds closure 3 in radical direction thus preventing rotation in bottle opening 2. The prevention of rotation can be enhanced, for example, by providing edge 11 of closure 3 with recesses that are partly entered by fixing element 6 thus bringing about an additional positive fixation.

As an alternative to the described conical, ground sealing surface 4, it is also possible to provide a kind of locking or threaded connection between closure 3 and bottle opening 2. To this end, it would be necessary already during the original shaping of the glass to provide such locking or holding elements, in the form of either threads or meshing extensions which during the insertion of closure 3 and the subsequent turning thereof in bottle opening 2 would cooperate in a manner much that closure 3 is held firmly axially and radially. The radial fixation should, however, be achieved or at least ensured in the afore-described fashion by means of fixing element 6.

If it is difficult, on the one hand, to provide the separation surface between closure 3 and bottle opening 2 with locking/holding elements or with a thread and, on the other, to create a required sealing surface 4, then an additional seal, for example in the form of a silicone or rubber ring, may also be inserted. Suitable for this purpose is, for example, the space shown in FIG. 3 and formed by a gap between bottle rim 9 and edge 11 of closure 3. At this site, a sealing ring could be pulled over closure 3 so that during the introduction of closure 3 into bottle opening 2 it would bring about the required sealing action.

A seal can, of course, be provided also when the separating surface is devoid of locking or holding elements or threads.

Figure 4:
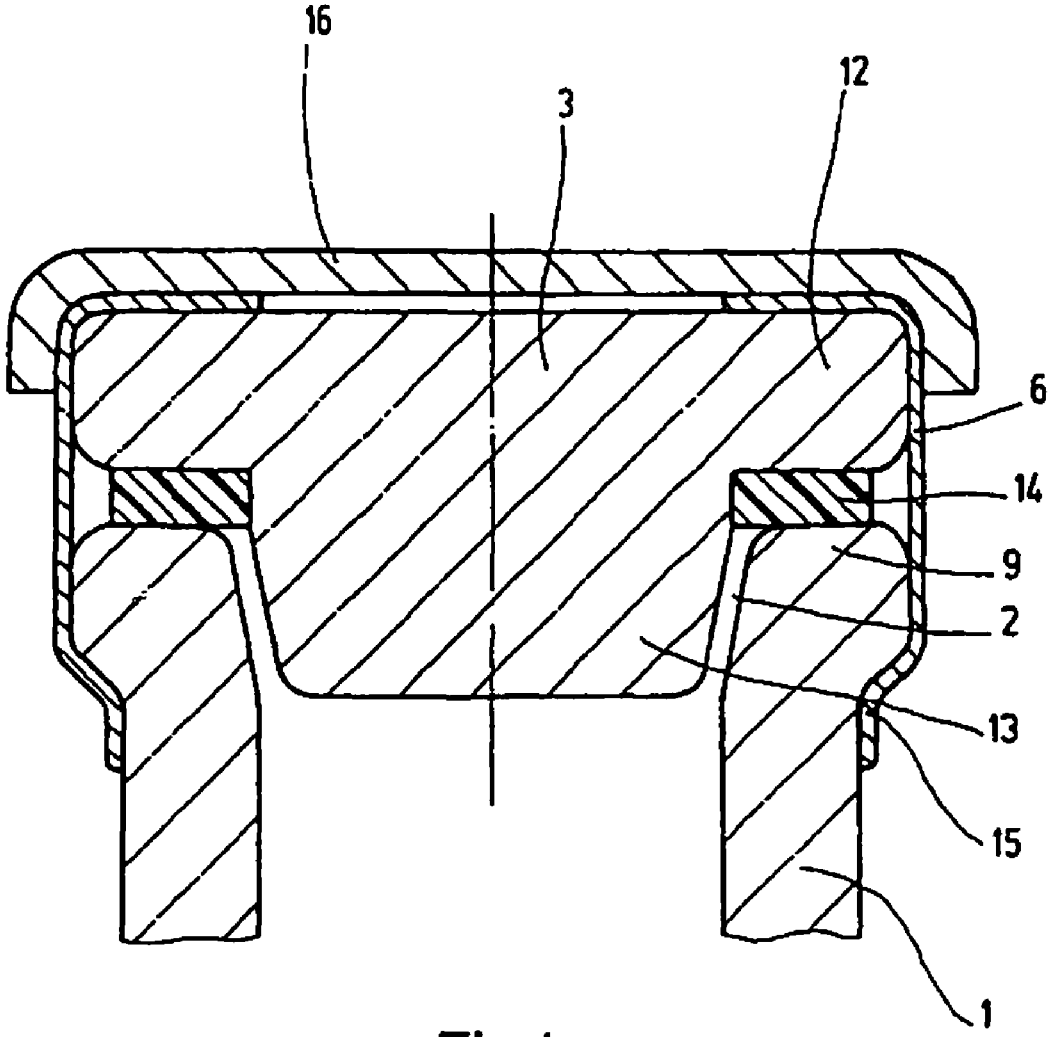
FIG. 4 shows a partial cross-section of a beverage bottle according to a third embodiment of the invention.

FIG. 4 shows as the third embodiment of the invention a further development of the second embodiment according to FIG. 3.

Closure 3 is provided with a flange 12 the outer diameter of which is essentially equal to the outer diameter of bottle rim 9 on bottle opening 2. Flange 12 merges with shaft 13 which in FIG. 4 first has a cylindrical part and then assumes a conical shape, but which can be entirely cylindrical. Onto the cylindrical part of shaft 13 is pushed a flexible, ring-shaped seal 14. Suitable sealing materials are, for example, plastics such as silicone or rubber, the hardness and elasticity of which must be selected so that a sufficient sealing power is ensured over long periods of time (years).

Seal 14 is disposed in the sealing surface between flange 12 of closure 3 and bottle rim 9.

Figure 5:
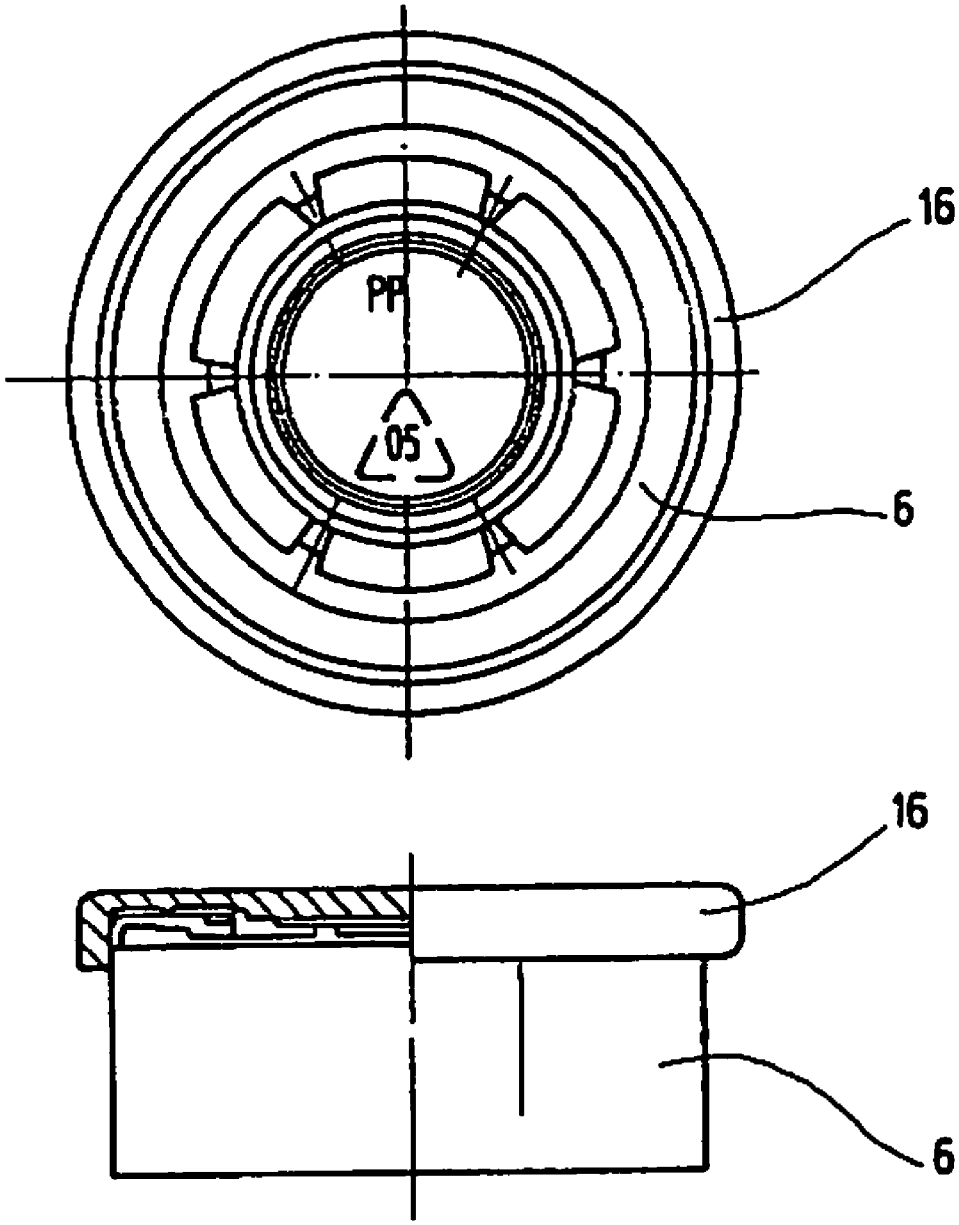
FIG. 5 shows a partial cross-section and a bottom view of a snap cap as fixing element.

Fixing element 6 holds closure 3 firmly in bottle opening 2. In the third embodiment shown in FIG. 4, closure 3 is held by fixing element in the form of a snap cap shown in FIG. 5 in partial cross-section and in bottom view. Such a snap cap has already found use as a means for protecting closures on infusion bottles.

The snap cap (fixing element 6) consists of a ring-shaped aluminum element which on its upper part is already preshaped, for example flanged, thus overlapping flange 12 of closure 3. It is slipped over closure 3 and bottle rim 9 and can then be deformed by means of an appropriate flanging tool so that it touches a back taper 15 formed between bottle rim 9 and bottle body 1. In this manner, closure 3 is held firmly in its position even when with seal 14 it is pressed against bottle rim 9 for the purpose of creating a suitable sealing force.

In the snap cap is provided a finger ring, not shown in the drawing, which is connected with the aluminum element, namely with fixing element 6, forming a singular unit and which must be bent in order to open the snap cap. It can then be torn downward so that the aluminum ring, namely fixing element 6, is detached and easily removed from closure 3.

The finger ring serving as safety element is disposed on the top side of the snap cap and can be protected with an attached covering cap 1.

Figure 6:
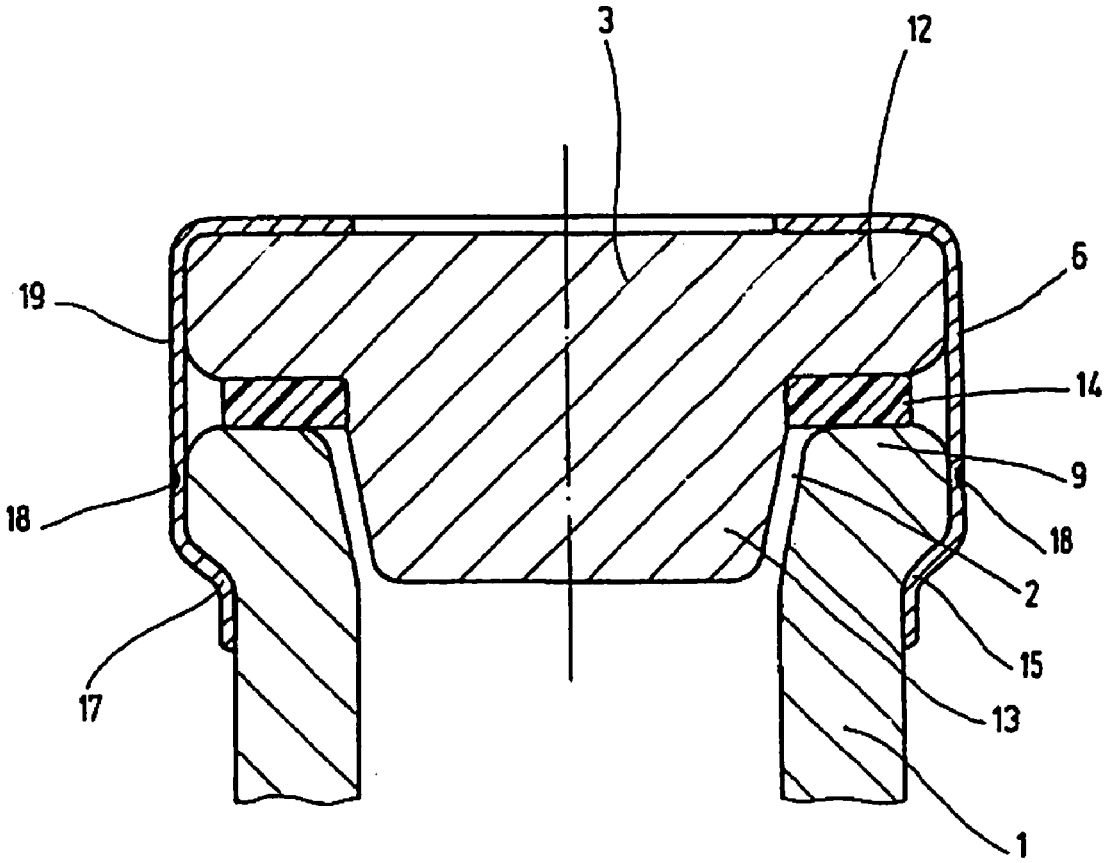
FIG. 6 shows a partial cross-section of a beverage bottle according to a further embodiment.

FIG. 6 shows another embodiment of the invention.

As previously shown in FIG. 4, closure 3 made of glass together with seal 14 rests in bottle opening 2 of bottle body 1.

Fixing element 6 has the shape of a ring or a sleeve or a flat seal. The sleeve can be open on a part of the top side of closure 3. Fixing element 6 is also referred to as "flanged cap." During assembly, namely the closing of the bottle, fixing element 6 is pushed over flange 12 of closure 3 and then flanged so that a lower part 17 of fixing element 6 engages at least in part back taper 15, as shown in FIG. 6.

The lower part 17 constitutes a safety element that firmly holds fixing element 6 axially.

Lower part 17 is connected with the upper part 19 via a connecting region 18 affording a single structure. Connecting region 18 can have the shape of an annular notch or of, for example, a horizontally extending perforation. Preferably, connecting region 18 is disposed at the level of bottle rim 9 so that a sufficient counterforce can be opposed to a knife used to cut open connecting region 18. It is also possible, however, to dispose connecting region 18 in the separating gap between flange 12 of closure 3 and bottle rim 9, particularly at the level of seal 14. In this case, the consumer can make a deep cut into connection region 18.

After fixing element 6 is detached at the connecting region 18, upper part 19 can readily be lifted so that closure 3 is easily accessible. Lower part 17 forming the safety element either remains attached to bottle rim 9 or drops off downward over the bottleneck. In this case, it is advantageous if lower part 17 is configured as a divided ring and, for example, up to the level of connecting region 18 is provided with a notch. Lower part 17 can then readily expand and be removed from the bottleneck. As an alternative, the ring forming lower part 17 can also be closed and have a vertical perforation at which, when it is to be removed, it can be opened manually or with an appropriate tool.

In the embodiment shown in FIG. 6, fixing element 6 is configured as a flanged cap. In this manner, sufficient firmness is ensured so that the required sealing force for seal 14 is ensured over an extended period of time. It is also possible, however, to make the fixing element 6 out of a plastic material, for example, in the form of a shrink cap, provided that the plastic material has sufficient strength and durability.

Figure 7:
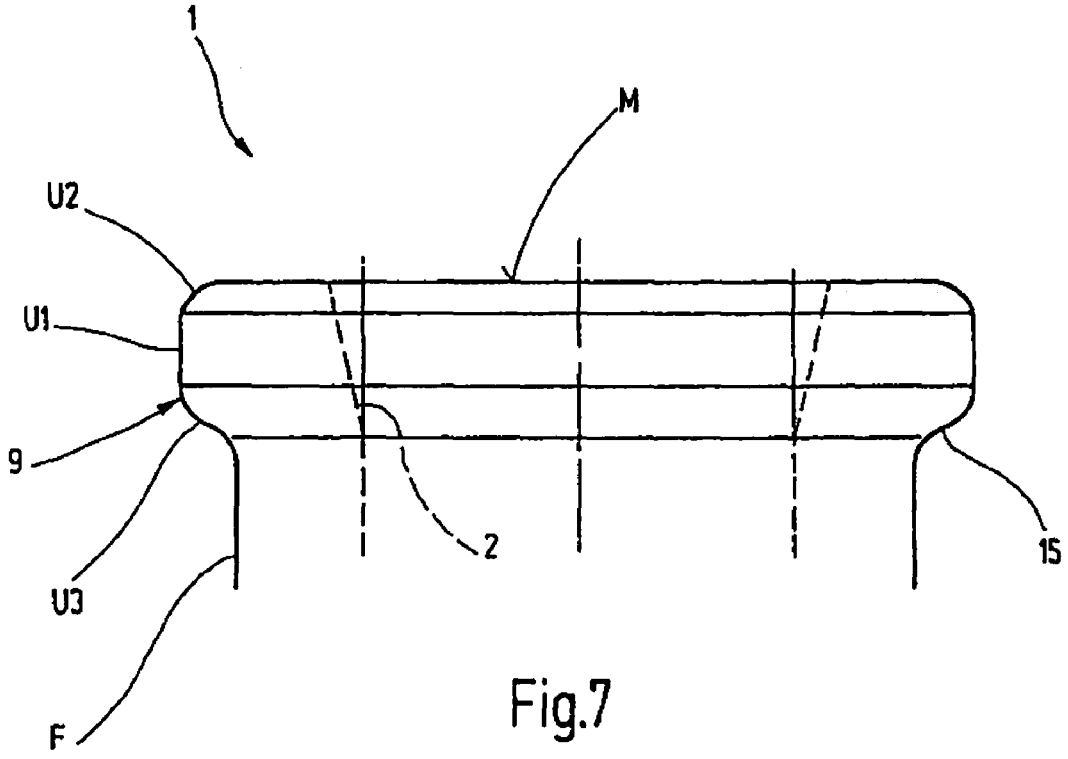
FIG. 7 shows a side view of the upper part of a bottle body, namely the bottle rim.

FIG. 7 shows an enlarged representation of the upper part of bottle body 1, namely bottle rim 9. The circumferential surface of bottle rim 9 has three different regions: a cylindrical region U1 extending over a substantial part of the height of bottle rim 9 and which can act as contact surface for fixing element 6 not shown in the drawing. As a result of the fact that here the fixing element rests and is supported in a safe manner, an all-around cut can be made into fixing element 6 with a tool, for example a knife, to be able to remove said fixing element from a closed bottle body 1.

Toward mouth M of bottle body 1, region U1 is followed by a second region U2 which is arched at a certain radius. Its purpose is to avoid a sharp edge that, on the one hand, would present a risk of injury and, on the other, would readily break off under impact.

Under region U1 is provided another region U3 which is arched and merges with bottleneck F located below bottle rim 9 so that the aforesaid back taper 15 is formed.

The broken line indicates bottle opening 2 which has a conical region adjoining mount M and in which rests closure 3.

Figure 8:
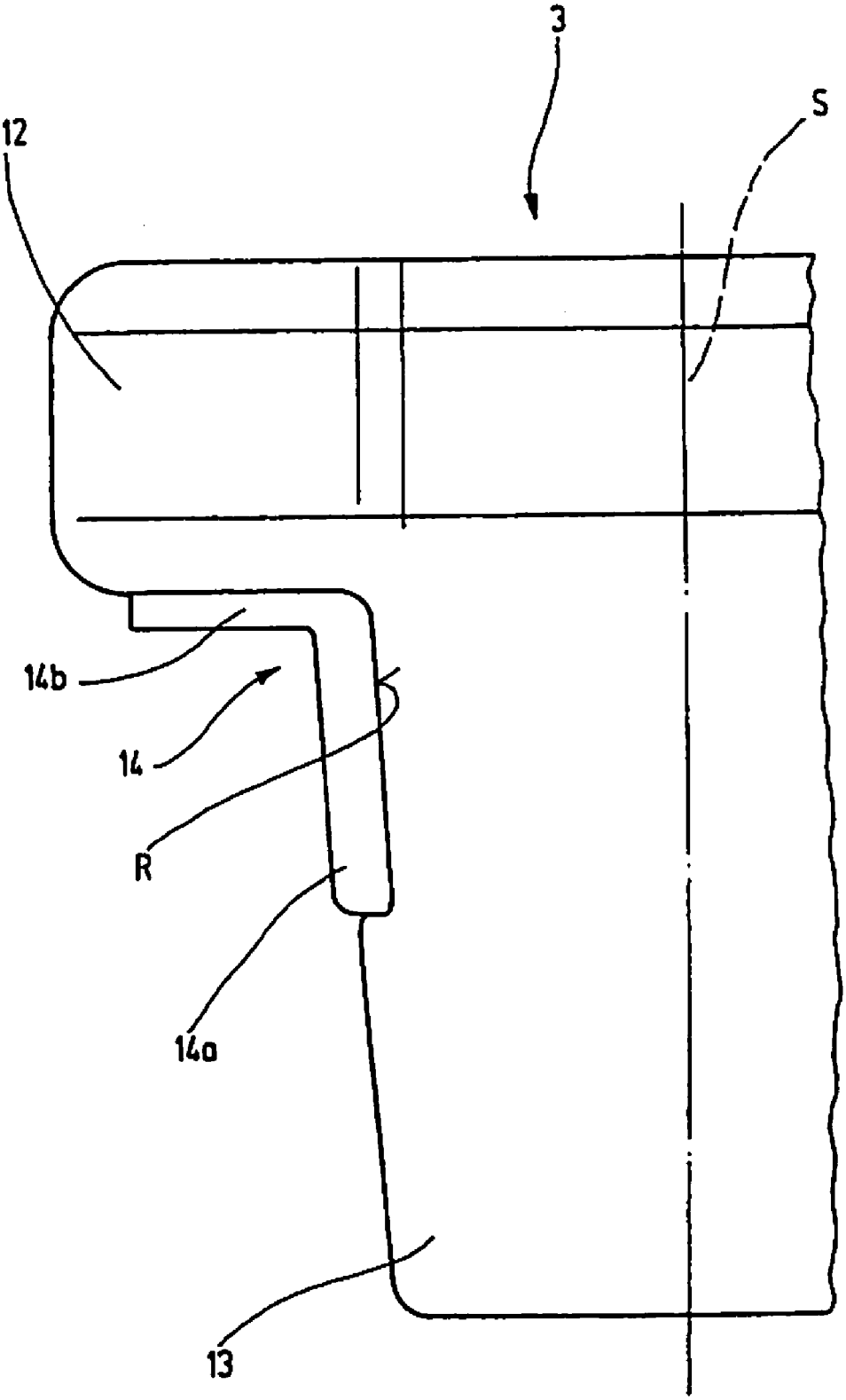
FIG. 8 is an enlarged representation of an embodiment of a closure

FIG. 8 shows another embodiment of a closure 3 in enlarged, partly cut off representation. The closure is symmetrical with respect to the center and symmetry axis S so that here only the left part of the closure is shown and explained in greater detail. The schematic drawing shows that the closure is provided with a flange 12 resting on mouth M of bottle body 1. Preferably, the outer diameter of flange 12 is adapted to bottle rim 9 as can be seen, for example, from FIGS. 4 and 6.

A special feature of closure 3 shown here is that in the peripheral surface thereof, below the flange, there is provided an all-around annular groove R the bottom of which is essentially conical shape and serves to receive a seal 14 which—seen in cross-section—is L-shaped and has a firm arm 14*a* that is disposed in annular groove R. As shown in this presentation, the second arm 14*b* extends horizontally and is disposed on the underside of flange 12. The length of second arm 14*b* is chosen so that this arm rests securely on the upper contact surface of bottle rim 9 and serves to seal bottle opening 2.

Flange 12 must not be resting directly on rim 9 of a bottle that is to be sealed. Between flange and rim, there must be left a gap so that the permissible axial variations of conical closure 3 can be compensated for. Arm 14*b* prevents direct contact between flange 12 and rim 9. As a result of the elasticity of the material, permissible axial variations can be compensated for when the gap between flange 12 and rim 9 is filled by arm 14*b*. The flexibility of arm 14*b* can be increased by providing on its surface facing rim 9 and/or facing flange 12 elevations and/or depressions which can be obtained, for example, by means of concentric or radially extending slots and/or more or less pointed elevations.

The first arm 14*a* seals bottle opening 2 in its conical region and is received under a preliminary tension between the inner surface of bottle opening 2 and the bottom of annular groove 7 so that this groove also serves to seal bottle body 1. The bottom of annular groove 7 is configured so that seal 14, namely the first arm 14*a* thereof, adheres here with its broad surface thus being subjected to a uniform pressing force so that it is uniformly pressed against the inner surface of bottle opening 2.

The thickness of first arm 14*a* can be chosen so that seal 14 alone seals the inner space of bottle body 1 when closure 3 is placed on bottle body 1. It is also conceivable, however, that the conical outer surface of shaft 13 of closure 3 which lies underneath seal 14, namely under first arm 14*a*, rests in sealing manner on the inner surface of bottle opening 2. In this case, closure 3 thus has two different sealing surfaces so that especially secure sealing of the contents of bottle body 1 is ensured.

It is clear from the explanations concerning arm 14*a* that when a closure 3 is placed on a bottle, tight sealing can be ensured even if arm 14*a* is entirely omitted. Seal 14 which is shown in FIG. 8 is then for all practical purposes configured as a conical sealing ring formed by arm 14*a*. It is essential for this embodiment that, as stated hereinabove, direct contact between flange 12 of closure 3 and rim 9 of a bottle be prevented. Here, during the closing of a bottle, a gap must remain which will take up the permissible axial variations of the conical closure.

Figure 9:
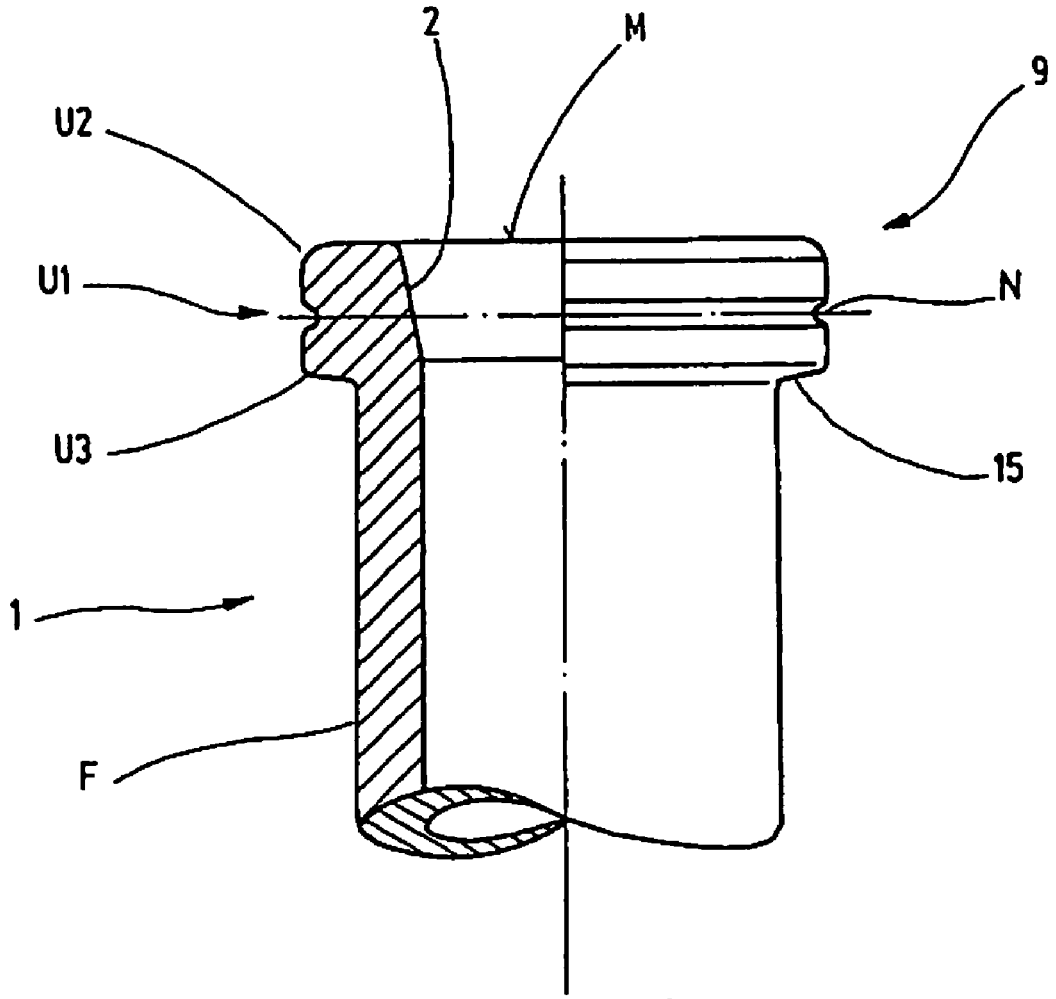
FIG. 9 shows a further embodiment of the upper part of a bottle body in partial cross-section.

FIG. 9 shows in partial cross-section the upper region of a bottle body 1 with a bottle rim 9 that is a modification of that shown in FIG. 7. Identical parts are indicated by the same reference numerals so that for such parts the reader is referred to the description for FIG. 7.

In the embodiment represented here, the cylindrical first region U1 of the peripheral surface of bottle rim 9 is provided with an all-around groove N which makes it particularly easy to cut into a fixing element 6, now shown in the drawing, which rests on the two parts of region U1 that above and below are adjacent to groove N. If in the region of groove N a knife is applied to fixing element 6, the knife can penetrate all the way to the bottom of groove N and readily cut into fixing element 6. In place of a knife, any more or less sharp object can be used because, as a result of the all-around groove, fixing element 6 can be pressed in and separated.

Figure 10:
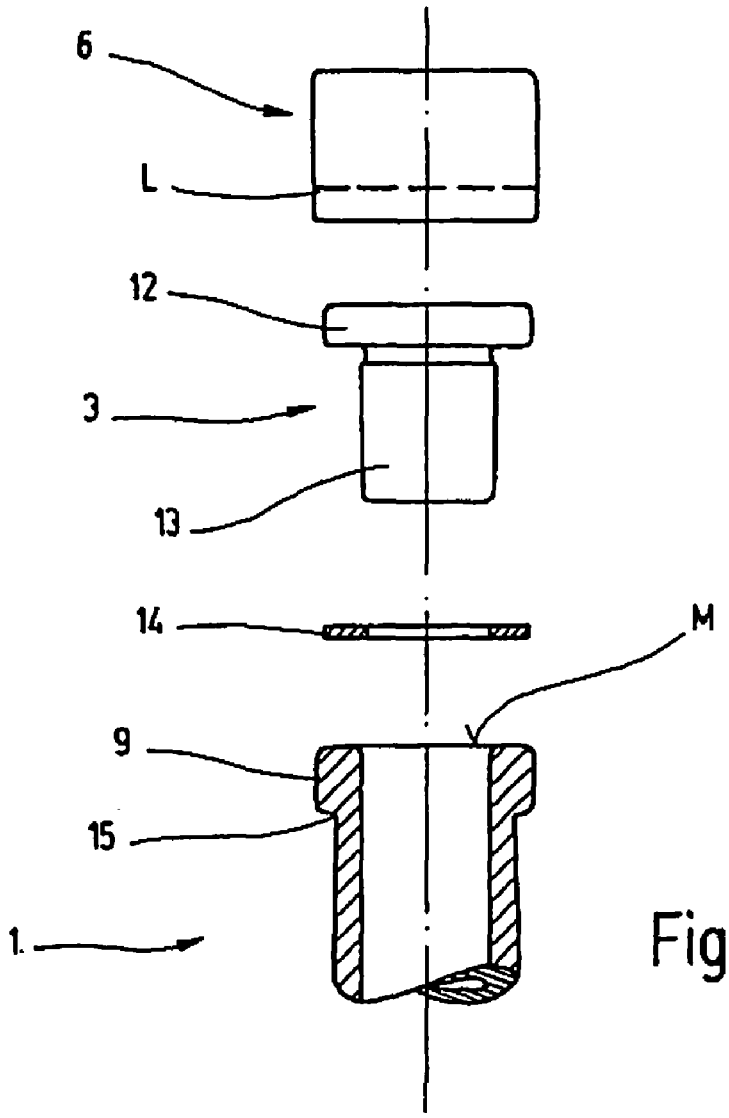
FIG. 10 shows an exploded view of the upper part of a bottle body with a seal, a closure and a fixing element.

FIG. 10 shows an exploded cross-sectional view of the upper part of a bottle body 1 with bottle rim 9 in cross-section and above it, at a distance, a seal 14, also in cross-section. Above the seal is disposed a closure 3 configured so that its shaft 13 can pass inside ring-shaped seal 14 and thus inside bottle body 1. Above shaft 13, which here is conically shaped, and below flange 12 can be seen a groove that extends all around and in which seal 14 rests when closure 3 is put in place.

Closure 3 has a flange 12 which extends over mount M of closure 3 and the outer diameter of which is approximately as large as the outer diameter of bottle rim 9.

Finally, above closure 3 is shown a fixing element 6. The essentially cylindrical outer surface of fixing element 6 shows in its lower region an all-around extending weakening line L which can be obtained by cuts disposed at a distance from each other between which are disposed essentially vertically extending, connecting cross-pieces.

Fixing element 6 can have the shape of a sleeve or a cap the upper limiting wall of which is closed. It can also be ring-shaped, however, and have an opening in the upper limiting wall as shown, for example, in FIG. 4.

Figure 11:
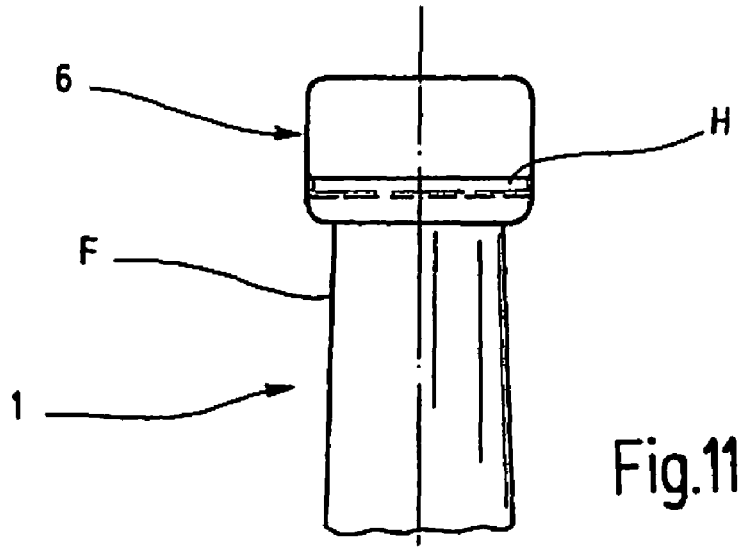
FIG. 11 shows the upper part of the bottle body with the closure in place.

FIG. 11 shows the elements presented in FIG. 10 in an assembled state. Closure 3 is disposed on top of bottle body 1, seal 14 resting between rim 9 and flange 12. The two parts cannot be seen, however, because fixing element 6 is slipped over closure 3 and the upper part of the bottle body. The lower part of fixing element 6 is flanged and engages back taper 15. As a result, fixing element 6 is securely held on bottle body 1.

In FIG. 11 it is indicated that fixing element 6 can be provided with a holding device, namely with at least one crease worked from the outside into the outer surface f fixing element 3, said crease being configured so that it engages below the lower edge of flange 12 of closure 3. The crease preferably extends all around. When fixing element 6 is removed, the crease holds closure 3 inside the fixing element so that said element together with closure 3 can be removed from bottle body 1 when the outer surface of fixing element 6 is separated in the region of weakening line L.

Bottle body 1 can be closed in simple manner with a standard closure head so that only a low head pressure is required. Said closure head is put in place with the aid of a common plunger that sets fixing element 6 on top of bottle body 1 and closure 3. Preferably, a capping procedure is not needed.

By means of a flanging device that can be part of the closure, the lower region of the outer surface of fixing element 6 is then flanged in the direction of bottleneck F so that said neck is adapted to bottle rim 9 in the region of back taper 15. When bottle body 1 is closed, holding device H can also be obtained by creating the, preferably all-around, crease by curling it from the outside into the outer surface of fixing element 6.

As a result of the fat that during the closing a defined pressure is applied to fixing element 6 and closure 3, seal 14 is pressed together in a defined manner and brings about the desired sealing of bottle body 1.

It is clear from the explanations that the closure procedure is applicable to bottles of different shape if the mouth region is adapted to the closing device, namely to the closure head. Bottle body 1 can consist of glass or stoneware. It is essential that said bottle body not adversely affect the bottle contents, particularly wine, but also, for example, other alcoholic beverages, oil or vinegar.

Not shown in the drawing is another embodiment in which a spring system is inserted between the top side of closure 3 and fixing element 6. When bottle 1 is closed, the spring is compressed with fixing element 6 and makes it possible that setting phenomena—either in seal 14 or as a result of a stretching of fixing element 6 that occurs with the passing of time—do not directly prevent the generation of sufficient sealing power. Rather, the spring system compensates for part of these setting phenomena and renders the closure overall less sensitive. Suitable spring systems are—depending on assembly space requirements—different kinds of springs made of metal or plastic material, it being possible for manufacturing-related reasons, to use also air springs, for example a plastic-enclosed air cushion. Other conceivable variants are, among others, disk springs, leaf springs, gel springs, etc.

The beverage bottle of the invention can be used particularly advantageously for industrial and commercial filling with wine as well as with other alcoholic beverages, oil or vinegar. Because of the afore-described ease of fabrication, for example, of a cast, pressed or ground conical seal seat (sealing surface 4), the fabrication costs can be reduced compared to those for a conventional natural cork closure. The resulting considerable economic advantage is enhanced by the fact that closure 3 made of glass increases the storage quality thus minimizing the risk of losses through leaky cork closures.

Figure 12:
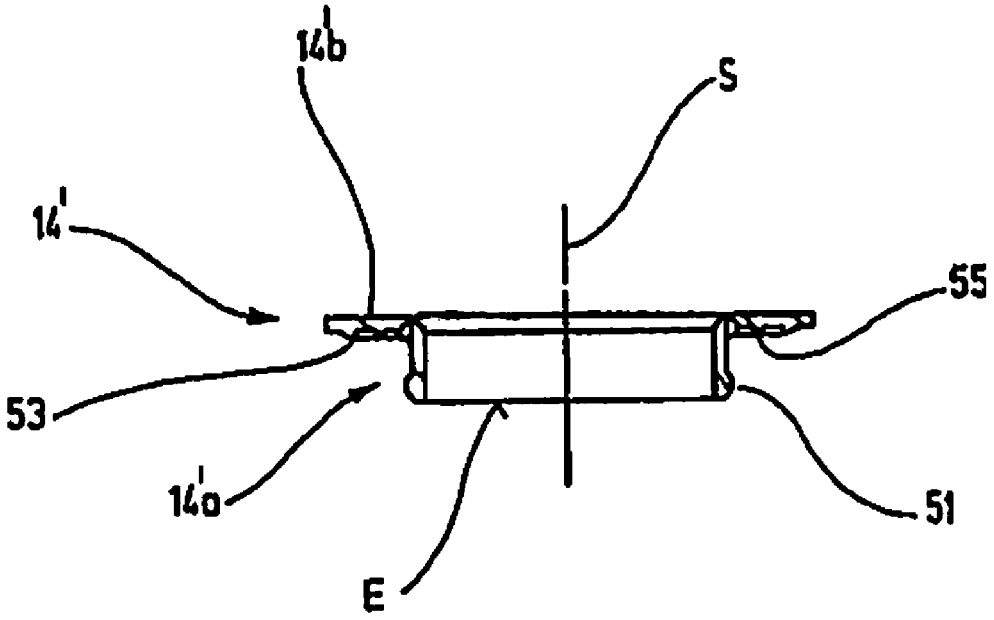
FIG. 12 shows a seal for a closure.

FIG. 12 shows a modified embodiment of a seal 14' as described in reference of FIG. 8. The reader is therefore referred to that description.

The difference between seal 14' and seal 14 lies in that first arm 14'*a* which is in contact with conical shaft 13 is provided at its lower end E with an all-around ring 51 which has a larger outer diameter than does the remainder of arm 14'*a*. In other words, the outer surface of first arm 14'*a* located above ring 51 rebounds toward ring 51.

Seen in cross-section, at its lower part that faces end E the ring has a conical shape, that is to say it widens in the upward direction forming a sharp angle thus facilitating the introduction of closure 13 into a bottle opening. The conical region extends practically over the entire height of ring 51 which rebounds only in the uppermost region and merges with the surface of arm 14'*a*.

The special configuration of ring 51 serves to reduce the area of contact with the bottle body, namely to reduce the friction during the opening and closing of a bottle. Moreover, greater material thickness is provided in the region of ring 51 than in the remainder of the first arm 14'*a* so that here seal 14' is somewhat yielding, but on the other hand sufficient material is also available for compensation of the permissible deviations in the mouth region of a bottle.

Self 14' thus closes mouth M of a bottle body 1 only in the region of ring 51.

In view of the desired basic function of ring 51, it is clear that said ring could also present a circular, arch-shaped outer surface to ensure, on the one hand, a relatively small contact surface and, on the other, a sufficient amount of material to provide certain yielding characteristics. The conical lower part of ring 51 shown in FIG. 12, however, is especially advantageous because it particularly facilitates the placement of closure 3 on a bottle body 1.

Here, the bottom side of second arm 14'*b* that extends essentially horizontally facing away from flange 12 of a closure 3, said flange not being shown in the drawing, is provided with two annular bulges 53 that are concentric with symmetry axis S of seal 14'. The drawing in FIG. 12 shows that the circular bulges, seen in cross-section, are V-shaped so as to provide a relatively small region of contact with bottle body 1. As with ring 51, this has the advantage that in the case of sugar-containing beverages closure 3 or seal 14' are not readily subjected to sticking. Otherwise, in the region of circular bulges 53 and 55, there exists a region of greater material strength that is sufficiently elastic to be able to compensate for permissible changes and unevenness.

Circular bulges 53 and 55 can extend all the way through or they can be interrupted by slots extending either in radial direction or at an angle to radial lines. Elevations positions on an imagined circular line are provided in this manner.

We have found that, in the embodiment of seal 14' presented here, arms 14'*a* and 14'*b* can be relatively thin so that a correspondingly small amount of material is needed for fabricating annular seal 14'. On the other hand, in the region of ring 51 and in the region of circular bulges 53 and 55, a sufficient amount of material is available to compensate for unevenness in the surface of the bottle and for permissible dimensional changes and yet to ensure sufficient pressing forces to bring about reliable sealing. In particular, in the configuration of ring 51 described here, namely when a conical inlet taper is present, the placement of a closure 3 onto bottle body 1 is particularly facilitated.

As stated in reference to the other embodiments, seal 14' is made of an elastic material which is neutral toward, namely does not adversely affect, the contents of bottle body 1.

Figure 13:
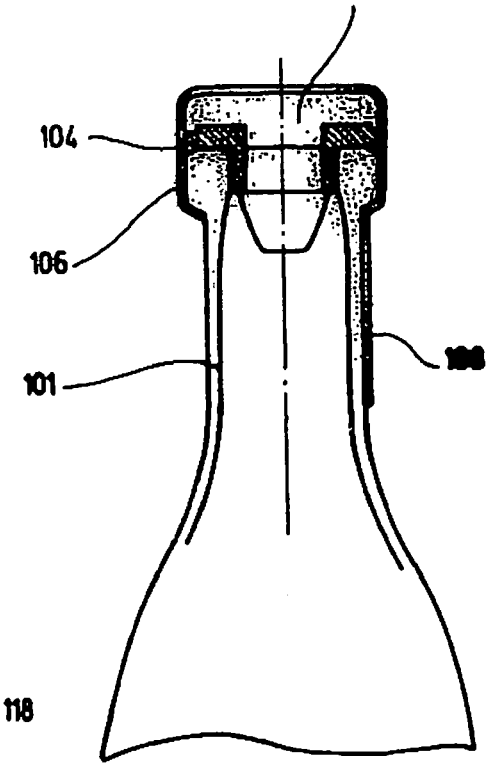
FIG. 13 shows part of a beverage bottle in longitudinal cross-section according to a further embodiment.

FIG. 13 shows in longitudinal cross-section a bottleneck 1 closed off by a glass or plastic stopper 103. Between stopper 103 and bottleneck 101 is disposed a sealing element 104. Closure 103 is fixed to bottleneck 101 by means of an aluminum cap 106. Reference numeral 108 indicates that closure 103 or stopper 103 can be fixed on the bottleneck also with the aid of a shrink film of plastic material or with pressed-on metal.

Figure 14:
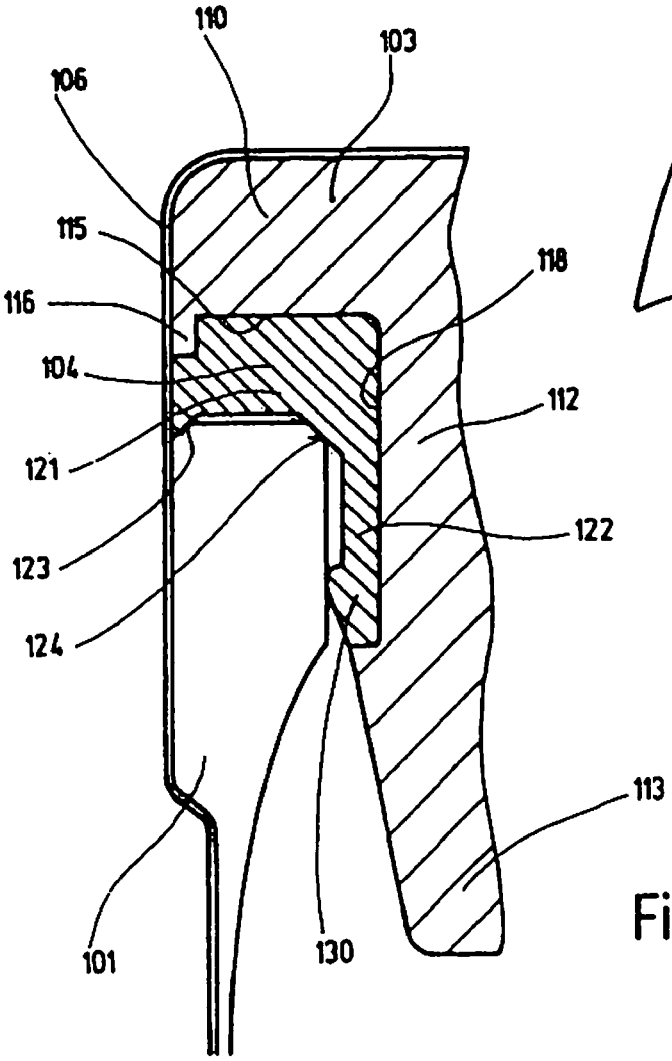
FIG. 14 shows an enlarged detail of FIG. 13.

In the enlargement shown in FIG. 14, in particular, it can be seen that sealing element 104 envelops an essentially circular edisk-shaped base 110 from the center of which extends an essentially circular cylinder-shaped guiding body 112. This free end of guiding body 112 becomes narrower. On the side facing bottleneck 101, base 110 is provided with a rectangular recess 115. Recess 115 is limited by a rectangular projection 116 formed radially outside on base 110 of closure 103. Rectangular recess 115 in base 110 merges with a rectangular recess 118 provided in guiding body 112.

The two rectangular recesses 115 and 118 form a receiving space for part of sealing element 104. Sealing element 104 comprises a first arm 121 and a second arm 122 which is disposed at a 90° angle to first arm 121. The free end of first arm 121 is disposed in a manner complementary to projection 116 of base 110 of closure 103. At the ends, on the surface of first arm 121 of sealing element 104 facing bottleneck 101, there are provided two flat areas 123 and 124 that face each other. The two flat areas 123 and 124 are disposed at an angle of about 45° to the corresponding surface of first arm 121. When the beverage bottle is in the closed condition, the rounded corner regions of bottleneck 102 rests on the two flat areas 123 and 124 of sealing element 104. Moreover, a bulge-like thickening 130 is provided at the free end of second arm 122 of sealing element 104, said thickening ensuring additional sealing even when closure 103 is not pressed against bottleneck 101 by fixing element 106.

In all embodiments, sealing element 104 can be cast onto closure 103. Sealing element 104, however, can also be installed separately in an additional work step. Moreover, it is possible to place sealing element 104 separately on bottleneck 101 and, in a separate work step, to install closure 103.

In the embodiments shown in FIGS. 13 and 14, when the beverage bottle is closed for the first time, sealing is brought about both by flat areas 123 and 124 and by circular bulge 130. Following the initial closing, closure 103 is pressed against bottleneck 101 by aluminum cap 106 which forms the fixing element. After removing aluminum cap 106 or after tearing off the closure film or shrink film 108, closure 103 is no longer pressed against bottleneck 101. As a result, during the second closing, sealing occurs only via annular bulge 130 at the end of second arm 122 of sealing element 104.

Figure 15:
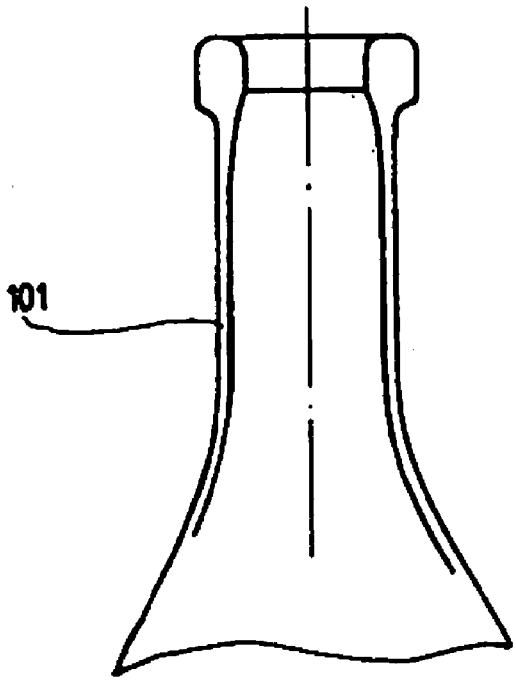
FIG. 15 shows part of a beverage bottle in longitudinal cross-section.

FIG. 15 shows a bottleneck 101 without seal and without closure and which resembles the bottleneck of FIGS. 13 and 14. Similarly, the embodiments shown in FIGS. 16 and 20 resemble the embodiments represented in FIGS. 13 and 14. For this reason, the same reference numerals are used to indicate identical or similar parts. In the following text, reference shall be made mainly to the differences between the individual embodiments. For a description of identical or similar parts, the reader is referred to FIGS. 13 and 14.

Figure 16:
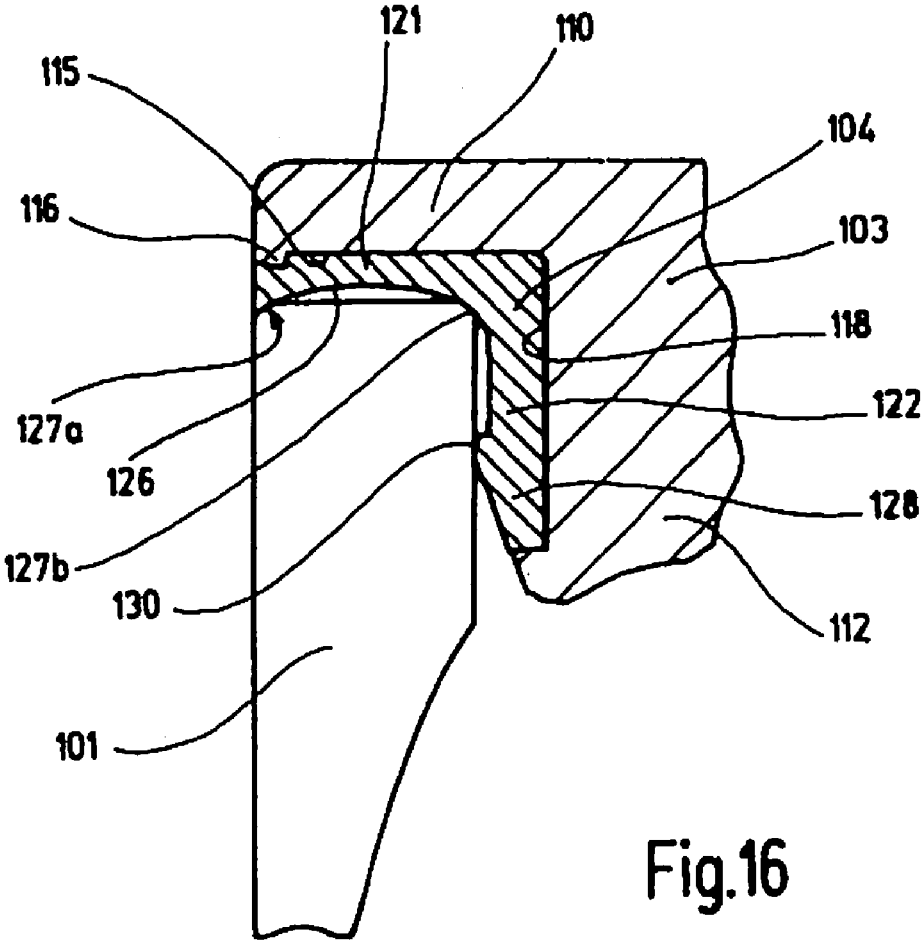
FIG. 16 shows an enlarged detail of FIG. 15 in the closed position.

The enlarged representation in FIG. 16 shows that projection 116 is not rectangular but essentially trapezoidal in shape. Moreover, surface 126 of first arm 121 of sealing element 104 facing bottleneck 121 is concave in shape. Cooperation with the corresponding, rounded edges of bottleneck 101 results in two sealing sites 127*a* and 127*b*. Concave surface 126 thus has practically the same effect as the two flat areas 123 and 124 of the embodiment represented in FIG. 14. Sealing element 104 represented in FIG. 16 is preferably applied onto stopper 103 before the closing process is carried out. Seal 104 can be cast onto stopper 103 consisting of a plastic material or of glass.

Figure 17:
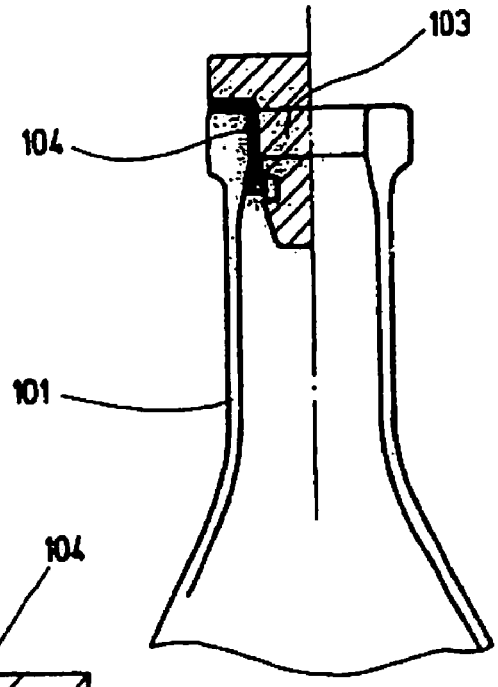
FIG. 17 shows part of a beverage bottle in longitudinal cross-section according to an another embodiment.
Figure 18:
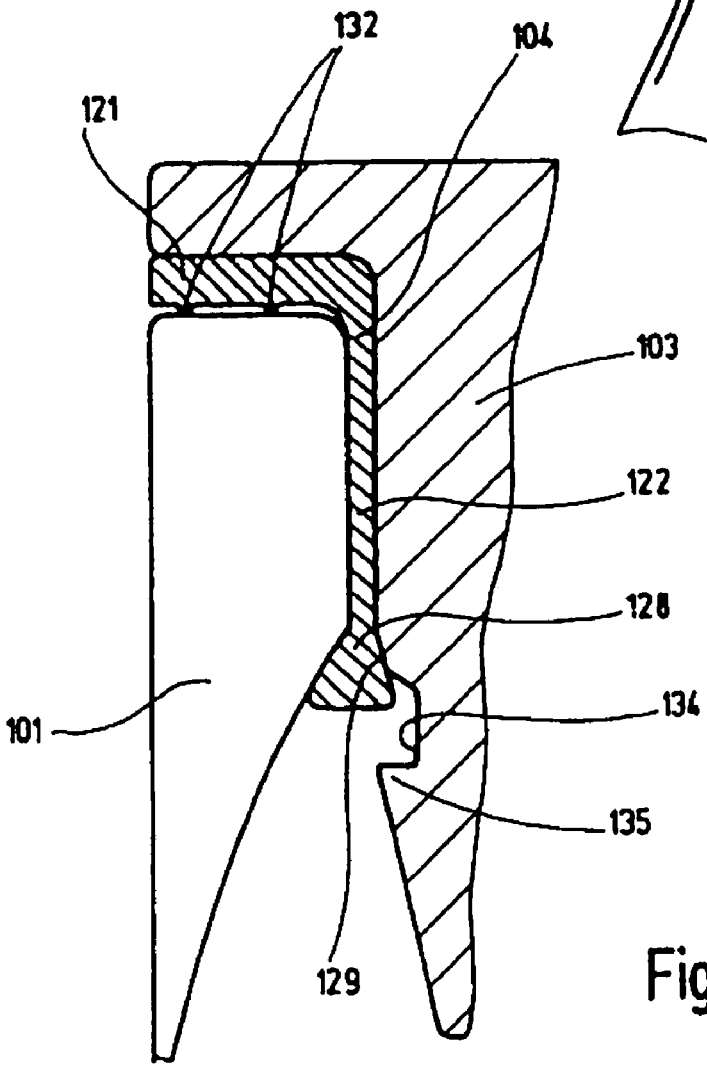
FIG. 18 shows an enlarged detail of FIG. 17.

In the embodiment shown in FIGS. 17 and 18, stopper 103 does not comprise recesses for receiving sealing element 104. Moreover, viewed in cross-section, two projections 132 are provided on the surface of first arm 121 of sealing element 104 facing bottleneck 101. The two projections 132 form annular bulges extending all around on the surface of first arm 121. The two annular bulges 132 serve as seals when closure 103 is pressed against bottleneck 101 with the aid of a fixing element (not shown in the drawing).

In the embodiments of FIGS. 14 and 16, the free end 128 of second arm 122 of sealing element 104 becomes narrower. In the embodiment represented in FIG. 18, free end 128 of second arm 122 of sealing element 104 becomes wider. In other words, free end 128, viewed in cross-section, forms a wedge one side of which rests on the inside of bottleneck 101 and the other side on a slightly slanted surface 129 of closure 103. A bulge 134 is provided on the closure as a continuation of slanted surface 129, viewed in cross-section. Bulge 114 forms a groove extending all around on closure 103 and during the opening of the beverage bottle serves to receive the widening free end 128 of second arm 122 of sealing element 104. Stopper 103 can be made of a plastic material or of glass.

In the embodiment represented in FIG. 18, seal 104 is preferably inserted separately before closure 103 is pressed into bottleneck 101. When closure 103 is removed, seal 104 is pulled out together with it. Nose 135 formed in the region of bulge 134 on closure 103 ensures that sealing element 104 is removed together with closure 103.

Figure 19:
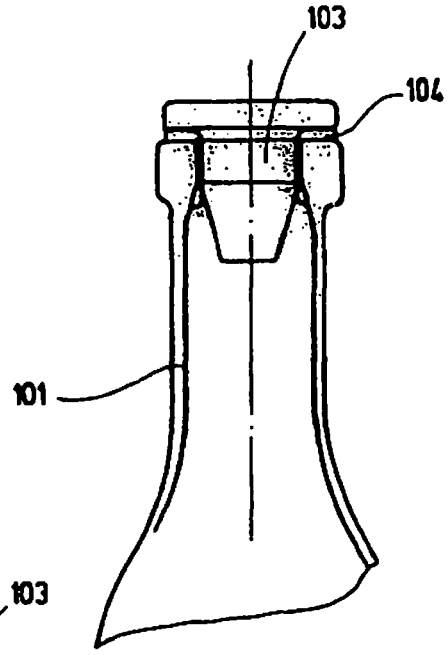
FIG. 19 shows part of a beverage bottle in longitudinal cross-section according to another embodiment.
Figure 20:
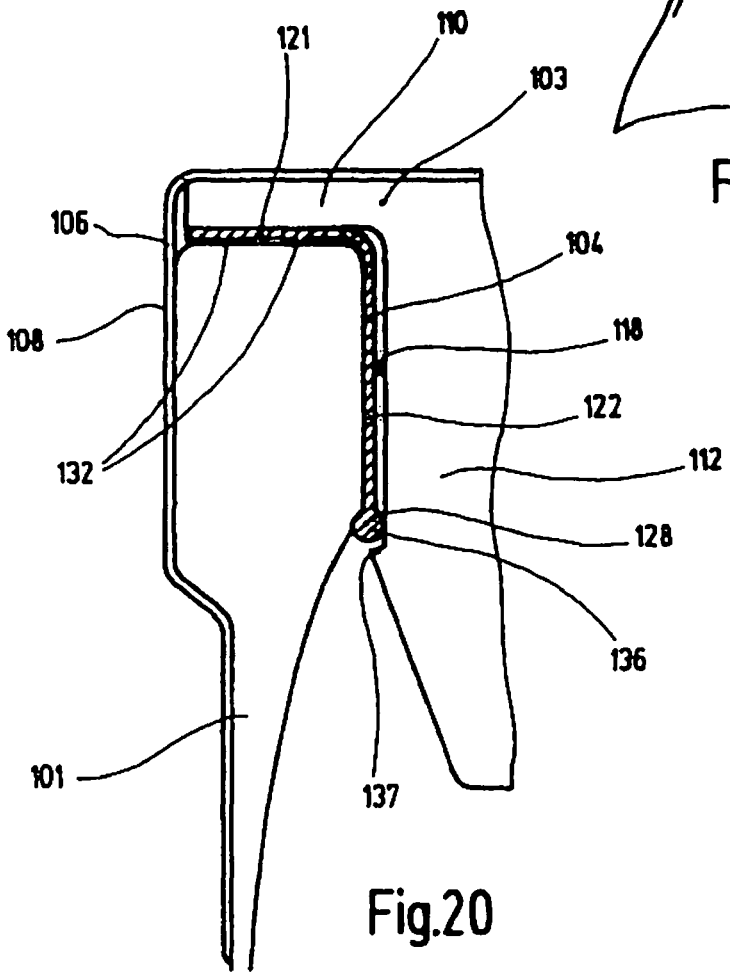
FIG. 20 shows an enlarged detail of FIG. 19.

In the embodiment shown in FIGS. 19 and 20, a rectangular recess 118 is provided only in the guiding body 112 of sealing element 104 and not in the base 110. As in the embodiment shown in FIG. 18, two projections 132 are provided on first arm 121 of sealing element 104, viewed in cross-section. Moreover, a thickening 136 is provided on second arm 122 of sealing element 104, at the free end 128. Thickening 136 forms an annular bulge which when the beverage bottle is in the closed condition makes contact with the inside f bottleneck 101 as well as with the periphery of guiding body 112 of closure 103. When, in the embodiment represented in FIGS. 19 and 20, the bottle is to be opened, seal 104 alone is first preferably placed into bottleneck 101. Closure 103, preferably made of glass, is then introduced in a subsequent step. When closure 103 is put in place, sealing bulge 136 is pressed by said closure against the inside of bottleneck 101. When the beverage bottle is opened, a nose 137 provided on closure 103 also removes sealing element 104.

In all embodiments, the closure can be fixed or secured on the bottleneck with a film, for example a shrink film. The closure can also be fixed to the bottleneck with a screening material, particularly with metal screening. The closure, however, can also be secured on the bottleneck with a strap or in some other manner.

The invention claimed is:

1. A beverage bottle comprising:

a bottle body provided with a bottle opening, the bottle body made of glass;

a closure which can be at least partly inserted into the bottle opening, the closure made of glass; and a fixing element which is detachably fastened to the bottle body and which holds the closure inserted into the bottle opening at least in an axial and/or radial direction;

wherein the fixing element and the closure are cooperatively configured to establish a positive connection to block turning of the closure in the bottle opening, whereby the fixing element is provided with a recess and the closure is integrally provided with a projection extending from a substantially planar top surface thereof, the projection matingly received by the recess and thereby forming the positive connection between the fixing element and the closure to prevent relative rotation between the fixing element and the closure;

wherein the projection has a length and a width, the length being greater than the width.

2. The beverage bottle of claim 1, wherein the fixing element can be positively fastened in the axial and/or radial direction to a bottle rim that adjoins the bottle opening.

3. The beverage bottle of claim 1, wherein the fixing element can be frictionally fastened to the bottle rim in the axial and/or radial direction.

4. The beverage bottle of claim 1, wherein the closure is rotationally symmetrical.

5. The beverage bottle of claim 1, wherein the closure includes at least one locking element on a periphery thereof that cooperates with a holding device provided on the bottle opening in a manner such that when the closure is turned in the bottle opening it can assume at least an open position in which the closure can be removed in the axial direction of the bottle opening and a closed position in which the closure is firmly held.

6. The beverage bottle of claim 1, wherein the closure has a conical outer surface.

7. The beverage bottle of claim 6, wherein the conical outer surface of the closure and a corresponding conical counter-surface in the bottle opening are ground.

8. The beverage bottle of claim 1, further comprising a gripping device on an upper side of the closure.

9. The beverage bottle of claim 8, wherein the gripping device has an extension with two lateral gripping surfaces oriented essentially perpendicular to the upper side of the closure.

10. The beverage bottle of claim 1, wherein:

the closure is provided with a flange having an outer diameter essentially the same as an outer diameter of a bottle rim adjoining the bottle opening;

a seal inserted between the closure and the bottle rim;

the bottle rim forming a back taper with the bottle body;

the fixing element is a ring extending all around the flange of the closure and the back taper at the bottle rim; and the safety element is a component part of the fixing element and can be torn off the fixing element so that the ring can be opened for the purpose of detaching the fixing element from the closure.

11. The beverage bottle of claim 1, wherein:

the closure is provided with a flange the outer diameter of which is essentially the same as the outer diameter of the bottle rim;

a seal is inserted between the closure and the bottle rim;

the bottle rim forms a back taper with the bottle body;

the fixing element is ring-shaped or sleeve-shaped and envelops the flange of the closure and the back taper at the bottle rim;

the fixing element is provided with a safety element that can be detached from the remainder of the fixing element so that at least the part of the fixing element extending around the flange of the closure can be removed.

12. The beverage bottle of claim 1, wherein the fixing element includes a safety element forming a lower part of the fixing element and is detachably connected with an upper part of the fixing element through a connecting region.

13. The beverage bottle of claim 12, wherein the connecting region comprises a weakening in the fixing element.

14. The beverage bottle of claim 13, wherein the weakening is formed by a ring-shaped notch or perforation in the fixing element.

15. The beverage bottle of claim 14, wherein the weakening extends horizontally at a level of the bottle rim or at a level of a separating gap between the bottle rim and the flange.

16. The beverage bottle of claim 12, wherein the safety element is configured as a closed ring with a perforation at which the ring can be opened.

17. The beverage bottle of claim 1, wherein the closure has a conical shaft the outer contour of which is essentially a conical outlet of the bottle opening.

18. The beverage bottle of claim 1, wherein the fixing element is a flanged cap or a shrink cap.

19. The beverage bottle of claim 1, wherein the fixing element is shaped like a cap which can be pushed axially over the closure and on which are provided elevations that engage a back taper on a rim of the bottle.

20. The beverage bottle of claim 1, wherein the positive connection between the fixing element and the closure is a form-locking connection.

21. The beverage bottle of claim 1, wherein the projection extends in a direction away from the bottle opening and substantially parallel to a longitudinal axis of the bottle body.

22. A beverage bottle comprising:

a bottle body provided with a bottle opening, the bottle body made of glass;

a closure which can be at least partly inserted into the bottle opening, the closure made of glass; and a fixing element which is detachably fastened to the bottle bad and which holds the closure inserted into the bottle opening at least in an axial and/or radial direction;

wherein the fixing element and the closure are cooperatively configured to establish a positive connection to block turning of the closure in the bottle opening, whereby the fixing element is provided with a recess and the closure is integrally provided with a projection extending from a substantially planar top surface thereof, the projection matingly received by the recess and thereby forming the positive connection between the fixing element and the closure to event relative rotation between the fixing element and the closure;

wherein the projection is constructed of glass.

23. The beverage bottle of claim 1, wherein the fixing element includes a generally planar portion disposed over the closure with a raised area disposed over the projection.

24. A beverage bottle comprising:

a bottle body provided with a bottle opening, the bottle body made of glass;

a closure which can be at least partly inserted into the bottle opening, the closure made of glass; and a fixing element which is detachably fastened to the bottle body and which holds the closure inserted into the bottle opening at least in an axial and/or radial direction;

wherein the fixing element and the closure are cooperatively configured to establish a positive connection to block turning of the closure in the bottle opening, whereby the fixing element is provided with a recess and the closure is integrally provided with a projection extending from a substantially planar top surface thereof, the projection matingly received by the recess and thereby forming the positive connection between the fixing element and the closure to prevent relative rotation between the fixing element and the closure;

wherein the fixing element includes a generally planar portion disposed over the closure with a raised area disposed over the projection; and wherein the raised portion is opposite the recess.

25. The beverage bottle of claim 1, wherein the closure is completely disposed within the bottle opening and the projection only partially extends above an upper end bottle body.

26. The beverage bottle of claim 1, wherein both the length and the width proximate the closure are substantially smaller than a diameter of the closure.

27. A beverage bottle comprising:

a bottle body provided with a bottle opening, the bottle body made of glass;

a closure which can be at least partly inserted into the bottle opening; and a fixing element which is detachably fastened to the bottle body and which holds the closure inserted into the bottle opening at least in an axial and/or radial direction;

wherein the fixing element and the closure are cooperatively configured to establish a positive connection to block turning of the closure in the bottle opening, whereby the fixing element is provided with a recess and the closure is integrally provided with a projection extending from a substantially planar top surface thereof, the closure and the projection commonly constructed of glass, the projection having a length and a width the length being greater than the width, both the width and the length being substantively less than an adjacent diameter of the closure, the projection matingly received by the recess and thereby forming the positive connection between the fixing element and the closure to prevent relative rotation between the fixing element and the closure.

* * * * *